US008529424B2

(12) United States Patent
Takahashi

(10) Patent No.: US 8,529,424 B2
(45) Date of Patent: Sep. 10, 2013

(54) CENTRIFUGE WITH NORMAL AND PULSED OPERATION MODES

(75) Inventor: Hiroyuki Takahashi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 841 days.

(21) Appl. No.: 12/717,115

(22) Filed: Mar. 3, 2010

(65) Prior Publication Data

US 2011/0059835 A1 Mar. 10, 2011

(30) Foreign Application Priority Data

Mar. 4, 2009 (JP) ..... 2009-051402

(51) Int. Cl.
*B04B 9/10* (2006.01)
*B04B 13/00* (2006.01)
*B04B 15/08* (2006.01)

(52) U.S. Cl.
USPC ..... 494/7; 494/11; 494/61

(58) Field of Classification Search
USPC ..... 494/1, 7–10, 11, 13, 14, 16–21, 60, 494/61, 84
See application file for complete search history.

(56) References Cited

U.S. PATENT DOCUMENTS

| | | | | |
|---|---|---|---|---|
| 4,857,811 | A | 8/1989 | Barrett et al. | |
| 4,952,370 | A * | 8/1990 | Cummings et al. | 422/28 |
| 5,431,620 | A * | 7/1995 | Schenck et al. | 494/7 |
| 6,682,631 | B2 * | 1/2004 | Cole | 159/6.1 |
| 6,817,970 | B2 * | 11/2004 | Berit et al. | 494/29 |
| 8,409,068 | B2 * | 4/2013 | Akatsu et al. | 494/1 |
| 2011/0059835 | A1 * | 3/2011 | Takahashi | 494/10 |
| 2011/0207590 | A1 * | 8/2011 | Ooyama et al. | 494/9 |

FOREIGN PATENT DOCUMENTS

| | | | | |
|---|---|---|---|---|
| JP | 60-119948 | U | | 8/1985 |
| JP | 62-17354 | U | | 2/1987 |
| JP | 1-184050 | A | | 7/1989 |
| JP | 2-9464 | A | | 1/1990 |
| JP | 9-75782 | A | | 3/1997 |
| JP | 2002-113391 | A | | 4/2002 |
| JP | 2005-152750 | A | | 6/2005 |
| JP | 2008023477 | A | * | 2/2008 |
| JP | 2009195875 | A | * | 9/2009 |
| JP | 2009268980 | A | * | 11/2009 |
| JP | 2010058089 | A | * | 3/2010 |

(Continued)

OTHER PUBLICATIONS

Japanese Office Action for the related Japanese Patent Application No. 2009-051402 dated May 30, 2012.
Japanese Office Action for the related Japanese Patent Application No. 2009-051402 dated Dec. 4, 2012.

*Primary Examiner* — Charles E Cooley
(74) *Attorney, Agent, or Firm* — Kenealy Vaidya LLP

(57) ABSTRACT

There is provided a centrifuge that includes a motor, a rotor chamber accommodating a rotor that is rotated by the motor, a vacuum pump that sucks air from the rotor chamber to reduce a pressure therein, a controller that controls the centrifuge to operate selectively in one of a normal centrifuge operation mode and a pulsed operation mode in which the rotor is rotated for a short time at a speed equal to or lower than a predetermined set value, and an interface device connected to the controller to input information regarding the operation mode of the centrifuge, wherein the controller controls the vacuum pump to turn on when the centrifuge operation mode is selected by the interface device and to turn off when the pulsed operation mode is selected.

9 Claims, 6 Drawing Sheets

(56) References Cited

FOREIGN PATENT DOCUMENTS

| | | | | |
|---|---|---|---|---|
| JP | 2010104944 | A | * | 5/2010 |
| JP | 2010131560 | A | * | 6/2010 |
| JP | 2010131585 | A | * | 6/2010 |
| JP | 2010201380 | A | * | 9/2010 |
| JP | 2010201403 | A | * | 9/2010 |
| JP | 2011139976 | A | * | 7/2011 |
| JP | 2011177703 | A | * | 9/2011 |
| JP | 2012152718 | A | * | 8/2012 |

* cited by examiner

CENTRIFUGE WITH NORMAL AND PULSED OPERATION MODES

CROSS-REFERENCE TO RELATED APPLICATIONS

This application is based upon and claims priority from Japanese Patent Application No. 2009-051402 filed on Mar. 4, 2009, the entire contents of which are incorporated herein by reference.

BACKGROUND OF THE INVENTION

1. Field of the Invention

An aspect of the present invention relates to a centrifuge, and more particularly to a pulsed operation function thereof in which the centrifuge is operated for a short time period to drop liquid droplets adhering to a sidewall in a sample container, in a high-speed centrifuge using a vacuum pump.

2. Description of the Related Art

Centrifuges are used in many fields such as the medical, pharmaceutical, and genetic engineering fields. For example, a wide variety of centrifuges ranging from those operating at 10,000 to 30,000 rpm under atmospheric pressure to those operating at 30,000 to 150,000 rpm are commercialized. In a high-speed centrifuge rotating at 30,000 rpm or more, the rotor is rotated while reducing the rotor chamber pressure by a vacuum pump to avoid heat generation of the rotor due to air friction. Usually, an oil-sealed rotary vacuum pump is used as a vacuum pump, and an oil diffusion vacuum pump is connected in series to assist the oil-sealed rotary vacuum pump. Depending on a sample to be centrifuged, separation may be performed while maintaining the sample at a temperature (for example, 4° C.) lower than room temperature. Therefore, a cooling device is disposed in the rotor chamber. Further, an air leak valve is disposed to introduce air into the rotor chamber for taking the rotor out from the evacuated rotor chamber.

When air is accidentally introduced into the rotor chamber in which the rotor is rotated at high speed, the rotor may generate heat to deteriorate the sample in the rotor. Further, depending on the rotation speed of the rotor, the rotor may be subjected to a lift force due to air turbulence, and the rotation of the rotor may be not stabilized. In order to prevent air from entering the rotor chamber even when, for example, an electrical power failure accidentally occurs, the air leak valve is often configured to be opened by an operation of a solenoid only when the solenoid is energized. In order to prevent the air leak valve from being opened during rotation by an erroneous operation of a control device, as a safety measure, control signals may be duplicated. A door lock mechanism which locks a door so as not to be opened during rotation is disposed to prevent the door from being accidentally opened to allow the hand to touch the rotor which is being rotated at high speed.

In a normal use of the above-described centrifuge, when the user sets the rotor, closes the door, and presses a start button, the door is locked by the door lock mechanism, the vacuum pump operates to start depressurization of the chamber, and then the rotor begins to rotate. In a centrifuge capable of rotating at a high speed of 30,000 rpm or more, in order to prevent the temperature increase by windage loss, the rotor is operated at low speed with limiting the rotation speed to about 5,000 rpm until the vacuum degree reaches a predetermined level, and, after the vacuum degree reaches the predetermined level, the rotor rotation is accelerated to the preset rotation speed. When the rotor reaches the user-preset rotation speed, the constant speed operation is performed. When the user-preset time period elapses or the user presses a stop button, the rotor is decelerated and stopped. The user performs a predetermined operation to cause the air leak valve to be opened, thereby releasing the door lock, and then takes out the rotor.

For example, a reagent or its liquid droplets adhering to the inner sidewall of a sample container tube is dropped onto the bottom thereof by being shaken by a hand in order to enhance the accuracy of the mixture ratio. Sometimes, the centrifuge is used instead of shaking the sample container tube. Such method is disclosed in, for example, JP-2002-113391-A. In the case, the rotor is operated only for a short time period to drop liquid droplets. In a centrifuge not having a vacuum pump and being capable of rotating only at 20,000 rpm or less, such a uses is well known as "pulsed operation" or "instantaneous centrifugal function". In the pulsed operation, a centrifuge is often used at a relatively low speed of about 15,000 rpm or less. Recently, a centrifuge having a switch for a pulsed operation mode has been put into practical use.

Unlike the normal centrifugal operation, in the pulsed operation, the rotor is required to reach a predetermined rotation speed, it is not important to maintain the rotation speed for a long time period, and it is usual to immediately reduce the speed. Therefore, a centrifuge has been commercially available which has a function of, only during a period when a pulsed operation button is pressed, operating the rotor in an accelerated or constant speed state, and, when the pulsed operation button is released, immediately starting deceleration to stop the rotor, or that of, when the pulsed operation button is pressed, accelerating to a predetermined rotation speed, and, immediately after the acceleration, decelerating or stopping the rotation.

However, the inventors have noted that a trouble occurs when a vacuum-pump-equipped centrifuge is similarly provided with the pulsed operation function. In the vacuum-pump-equipped centrifuge, the vacuum pump is automatically operated with the start of the rotation of the rotor, and hence a step which continues for several seconds, and in which, after the stop of the pulsed operation, an air leak valve is opened and the pressure in a chamber is returned to the atmospheric pressure is required. The pulsed operation requires merely ten to several tens of seconds. Therefore, when the above-mentioned step of returning the pressure in the chamber to the atmospheric pressure is added, the working efficiency is largely decreased. Since the pulsed operation itself requires a low rotation speed, it is not necessary to set the vacuum state. When operating the vacuum pump, in order to prevent evaporation of the sample from being caused by the vacuum state of the chamber, or freezing by releasing of heat of vaporization from occurring, a cover should be surely closed. Each time when an insignificant work of the pulsed operation is to be performed, therefore, the cover must be attached, thereby deteriorating the workability.

SUMMARY OF THE INVENTION

According to one aspect of the invention, in a centrifuge having: a motor; a rotor chamber which houses a rotor that is rotated by the motor; a vacuum pump which sucks air from the rotor chamber to reduce the pressure; and a controlling portion which controls operations of the components, a pulsed operation mode in which the rotor is rotated without operating the vacuum pump is disposed. In the pulsed operation mode, the rotor is rotated at a speed equal to or lower than a first rotation number which is lower than a maximum rotation number of the rotor in a case where the vacuum pump is operated. The centrifuge further has an interface portion which receives an operation from a user, and an operation start button (for example, a start button) for starting rotation of the rotor is disposed in the interface portion.

According to another aspect of the invention, the centrifuge is configured so that, when the operation start button is pressed for a predetermined time period or longer, the centrifuge is switched to the pulsed operation mode, and the rotor is accelerated, and, when the operation start button is released, the rotor is decelerated to stop. With respect to the start of the acceleration, a dedicated button (for example, a PULSE button) is disposed as the operation start button in the interface portion, and the centrifuge may be configured so that, when the dedicated button is pressed, the pulsed operation mode may be performed. The centrifuge may be configured so that, when the dedicated button is pressed, the rotor is accelerated, and, when the dedicated button is released, the rotor is decelerated to stop. The centrifuge may be configured so that, when the dedicated button is pressed, the rotor is accelerated, and, after an operation of a predetermined time period, the rotor is decelerated to stop. The centrifuge may be configured so that, when the dedicated button is pressed, the rotor is accelerated, and, when the first rotation number is attained, the rotor is decelerated to stop.

According to a further aspect of the invention, the centrifuge further has a displaying portion which displays information, and, in the pulsed operation mode, identification information indicating that the vacuum pump stops is displayed on the displaying portion.

According to a still further aspect of the invention, in a centrifuge having: a motor; a rotor chamber which houses a rotor that is rotated by the motor; a vacuum pump which sucks air from the rotor chamber to reduce the pressure; an air leak valve which connects or disconnects the rotor chamber to or from ambient air; and a controlling portion which controls operations of the components, a pulsed operation mode in which the rotor is rotated for a short time period is disposed, and, in the pulsed operation mode, the vacuum pump is operated while the air leak valve is closed, the rotor is rotated at a speed equal to lower than a first rotation number which is lower than a maximum rotation number of the rotor that can be set in the centrifuge, and, when the speed is equal to or lower than a second rotation number during deceleration of the rotor, the air leak valve is opened to introduce ambient air into the rotor chamber.

According to a first aspect of the invention, the pulsed operation mode in which the rotor is rotated without operating the vacuum pump is disposed, and hence evaporation of a sample due to pressure reduction during the pulsed operation mode is suppressed. Since the vacuum pump is not operated, the time period required for opening and closing the air leak valve is not necessary, and hence the pulsed operation can be completed within a short time period. Since the vacuum pump is not operated, energy can be saved.

According to a second aspect of the invention, in the pulsed operation mode, the rotor is rotated at a speed equal to lower than the first rotation number which is lower than the maximum rotation number of the rotor in the case where the vacuum pump is operated. Therefore, the time period for introducing ambient air into the rotor chamber after the pulsed operation mode is ended is not required, and a cover for preventing gasification or evaporation of the sample from occurring is not necessary to be attached to the rotor.

According to a third aspect of the invention, the operation start button for starting rotation of the rotor is disposed in the interface portion. Therefore, it is possible to provide a centrifuge in which the pulsed operation mode can be started by operating the button in the interface portion, and which is excellent in easiness of use.

According to a fourth aspect of the invention, when the operation start button is pressed for a predetermined time period or longer, the centrifuge is switched to the pulsed operation mode, and the rotor is accelerated, and, when the operation start button is released, the rotor is decelerated to stop. Therefore, the normal centrifuge operation and the pulsed operation mode can be switched over by using the single operation start button such as a start button, and the number of buttons can be prevented from increasing.

According to a fifth aspect of the invention, the dedicated button is disposed as the operation start button in the interface portion, and, when the dedicated button is pressed, the pulsed operation mode is performed. Therefore, it is possible to realize an operating environment in which the user can be prevented from erroneously recognizing the mode that is to be operated by the user.

According to a sixth aspect of the invention, when the dedicated button is pressed, the rotor is accelerated, and, when the dedicated button is released, the rotor is decelerated to stop. Therefore, it is possible to realize an operating environment in which the centrifuge is easily used in the pulsed operation where the rotor is rotated only for a very short time period.

According to a seventh aspect of the invention, when the dedicated button is pressed, the rotor is accelerated, and, after an operation of a predetermined time period, the rotor is decelerated to stop. Therefore, the user is requested only to instruct the start of the pulsed operation, and hence the operability is improved.

According to an eighth aspect of the invention, when the dedicated button is pressed, the rotor is accelerated, and, when the speed reaches the first rotation number, the rotor is decelerated to stop. Therefore, the rotor can be surely accelerated to the rotation number which is required for the pulsed operation.

According to a ninth aspect of the invention, the centrifuge further has the displaying portion which displays information, and, in the pulsed operation mode, identification information indicating that the vacuum pump stops is displayed on the displaying portion. Therefore, the user can surely know that the vacuum pump stops, during the pulsed operation.

According to a tenth aspect of the invention, in the pulsed operation mode, the rotor is rotated at a speed equal to lower than the first rotation number which is lower than the maximum rotation number of the rotor in the case where the vacuum pump is operated, and, when the speed is equal to or lower than the second rotation number during deceleration of the rotor, the air leak valve is opened to introduce ambient air into the rotor chamber. When the rotor stops, therefore, the pressure in the rotor chamber is returned to the atmospheric pressure. Consequently, the time period for introducing ambient air into the rotor chamber after the pulsed operation mode is ended is not required. As a result, the pulsed operation can be completed within a short time period.

According to an eleventh aspect of the invention, the centrifuge further has the interface portion which receives an operation of the user, and, when the operation start button of the interface portion is pressed in the pulsed operation mode, the rotor is accelerated, and, when the operation start button is released, the rotor is decelerated to stop. Therefore, it is possible to realize an operating environment of the pulsed operation which is excellent in easiness of use.

DETAILED DESCRIPTION OF THE INVENTION

Embodiment 1

Figure 1:
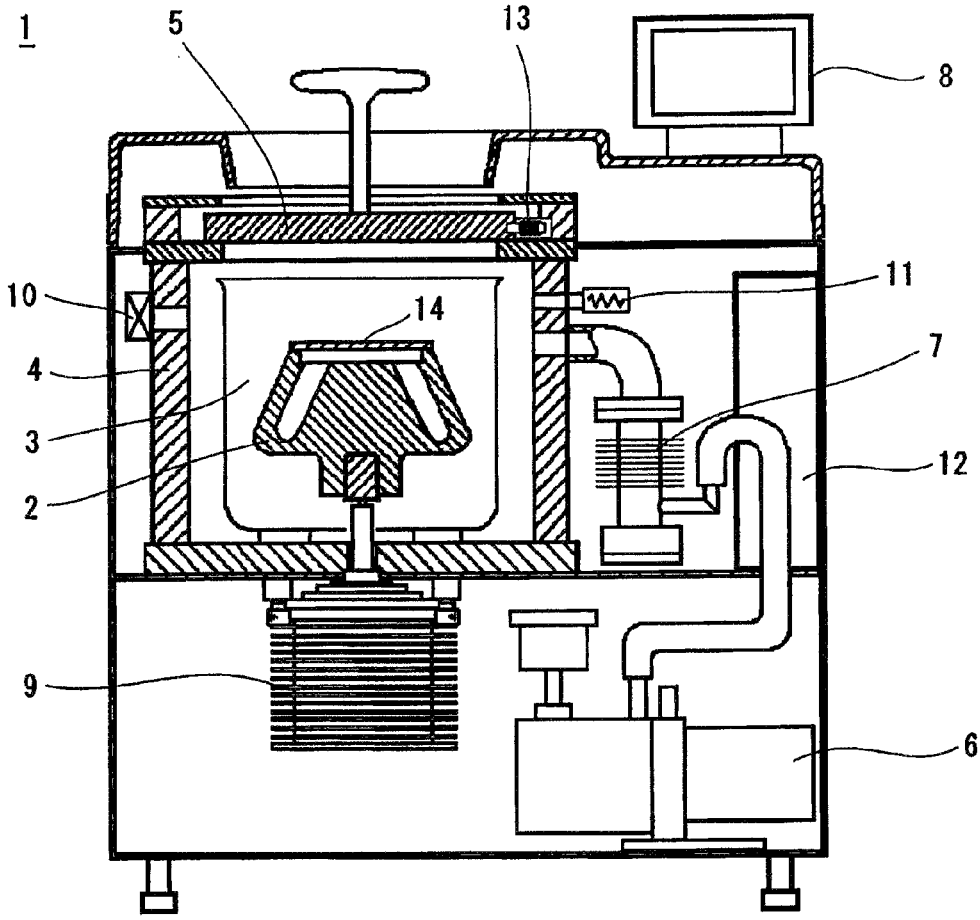
FIG. 1 illustrates an example configuration of a centrifuge of an embodiment.

A centrifuge of an embodiment will be described with reference to FIG. 1. FIG. 1 illustrates the configuration of the centrifuge of the embodiment. The centrifuge 1 includes: a rotor 2 which is rotated while holding a sample; a rotor chamber 3 which houses the rotor 2; a vacuum chamber 4 which surrounds the rotor chamber 3 to form an enclosed space; a door 5 for closing an opening which is disposed to allow the rotor 2 to be taken in and out of the vacuum chamber 4; an oil-sealed rotary vacuum pump 6 which reduces the pressure in the vacuum chamber 4; an oil diffusion vacuum pump 7 which is connected in series between the oil-sealed rotary vacuum pump 6 and the vacuum chamber 4; an interface portion 8 through which the user sets centrifuge conditions, and confirms operation conditions; a motor 9 which rotates the rotor 2; an air leak valve 10 which connects or disconnects the interior of the vacuum chamber 4 to or from ambient air (the outside of the vacuum chamber) by opening or closing of the valve; a vacuum sensor 11 which measures the pressure in the vacuum chamber 4; a controlling portion 12; and a door lock 13 which locks the door 5.

The controlling portion 12 includes a microcomputer (not shown) is configured to receive a signal from the vacuum sensor 11 through a signal line (not shown), and to control the whole of the centrifuge 1 to perform operations such as: the rotation control of the motor 9; the ON/OFF control of the oil-sealed rotary vacuum pump 6; the ON/OFF control of the oil diffusion vacuum pump 7; displaying of information on the interface portion 8 and acquiring of input data from the interface portion 8; locking and unlocking of the door lock 13; and opening and closing of the air leak valve 10. The interface portion 8 is configured by, for example, touch-panel-type liquid crystal display, or a combination of a display device and an inputting device. The interface portion 8 is configured to display information for the user, and to receive operation instructions from the user.

A detachable cover 14 is disposed on the rotor 2 so as to effectively prevent evaporation of the sample housed in a container when the rotor chamber 3 is evacuated, or to reduce the windage loss when the centrifuge 1 is operated in the atmosphere. In the case where the centrifuge 1 is operated while evacuating the rotor chamber 3, or the rotor 2 is rotated at high speed, the cover 14 may be attached. On the other hand, during the pulsed operation where the rotor is rotated at low speed only for a short time period under atmospheric pressure, the cover 14 may not be attached.

Figure 2:
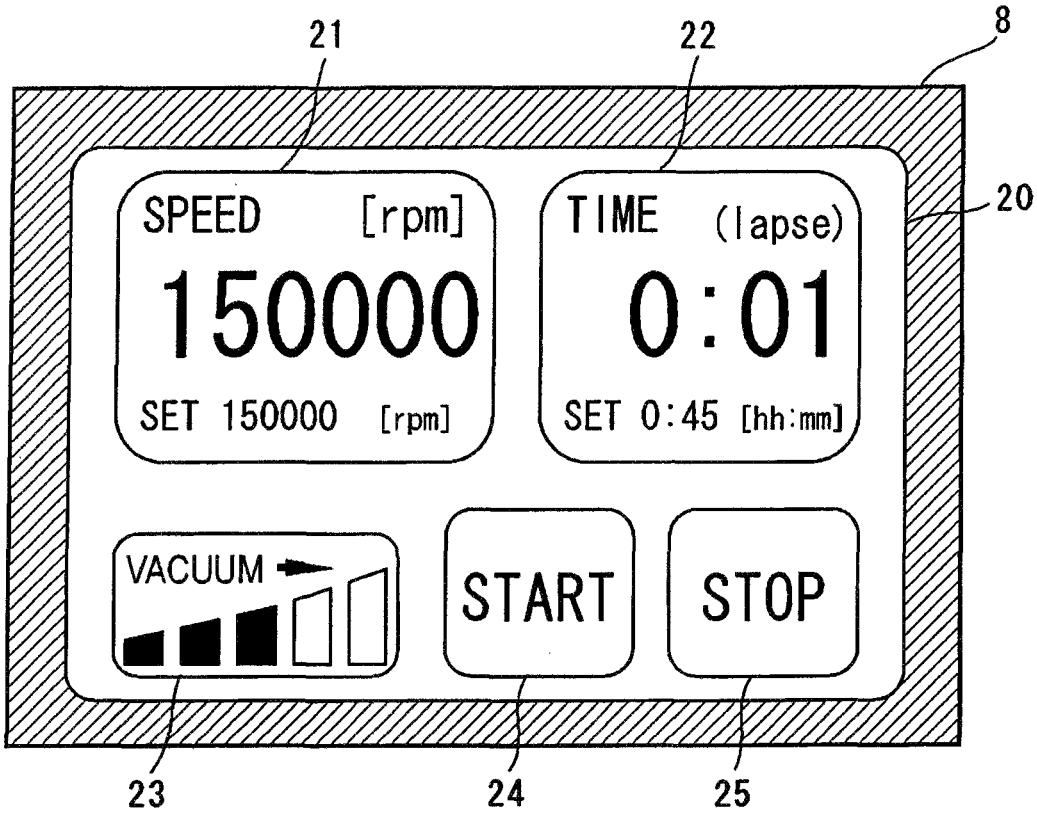
FIG. 2 illustrates an exemplary display screen 20 of an interface portion 8 in a normal operation of a centrifuge 1.

The display contents of the interface portion 8 will be described with reference to FIGS. 2 and 3. FIG. 2 illustrates an example display screen 20 of the interface portion 8. In the embodiment, the interface portion 8 of a touch-panel-type liquid-crystal-display device is exemplified. A rotation speed displaying region 21, an operation time period displaying region 22, and a vacuum degree displaying region 23 are disposed in the display screen 20. The centrifuge conditions and various kinds of information during operation are displayed in the regions. Further, a START button 24 and a STOP button are displayed on the display screen 20. In the rotation speed displaying region 21, a preset rotation number for the centrifuge operation is displayed in the lower portion, and the center large characters indicate the current rotation number of the rotor 2. In the example of FIG. 2, the preset rotation number is 150,000 rpm and the rotor is rotating at 150,000 rpm. In the operation time period displaying region 22, a preset operation time period is displayed in the lower portion, and the center large characters indicate the current elapsed time period. In the example of FIG. 2, the preset operation time period for centrifuge is 45 minutes, and the centrifuge has been operated for 1 minute.

In the vacuum degree displaying region 23, the vacuum degree in the rotor chamber 3 is indicated by five indicators. In the state of the atmospheric pressure, no indicator is displayed. As the air pressure is further reduced (the air pressure of the vacuum chamber 4 is further reduced), the indicators are sequentially displayed with starting from the left side. When the vacuum degree reaches the maximum, the five indicators are displayed. The START button 24 is a button for starting the normal centrifuge operation. When the user touches (presses) the START button 24, the normal centrifuge operation is started. The STOP button 25 is a button for suspending the centrifuge operation.

Figure 3:
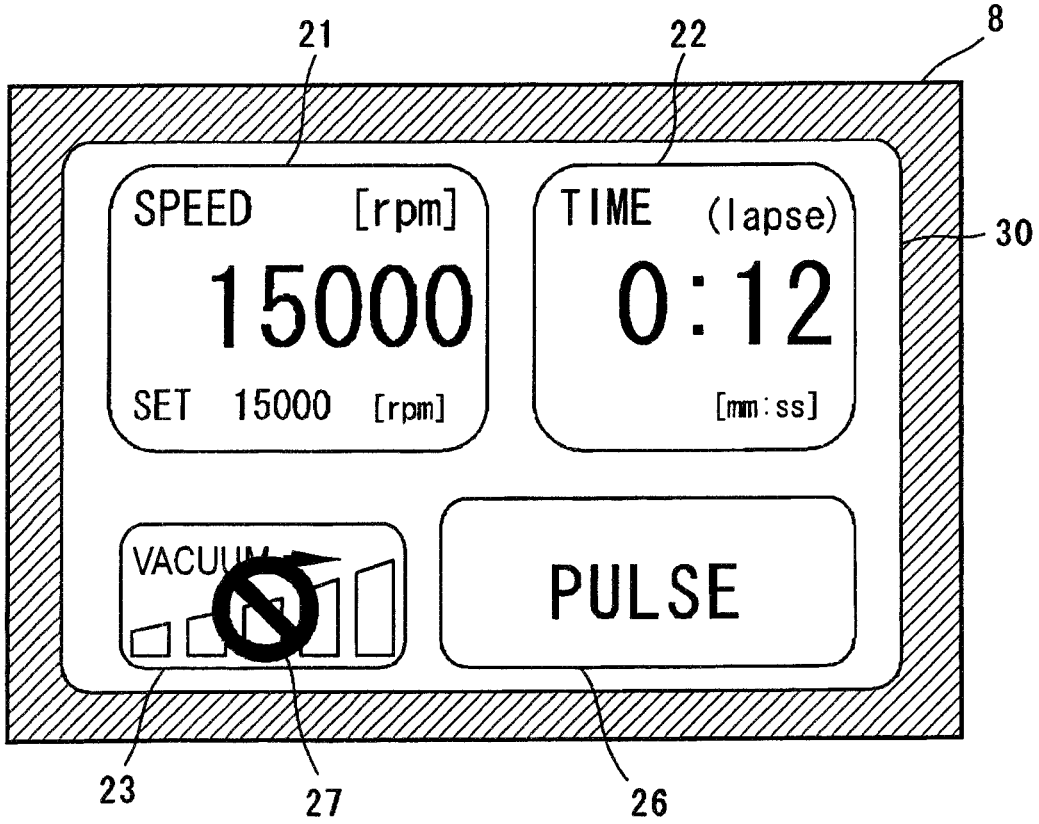
FIG. 3 illustrates an exemplary display screen 30 of the interface portion 8 in a pulsed operation of the centrifuge 1.

FIG. 3 illustrates an example display screen 30 of the interface portion 8 in the pulsed operation of the centrifuge 1. In the embodiment, when "pulsed operation mode" is selected in a MENU screen (not shown) of the interface portion 8, the display content of FIG. 2 is switched to that of FIG. 3. By such display content switching, the user can easily know which one of the operation modes is currently selected. In the display screen 30 in the pulsed operation, the rotation speed displaying region 21 and the operation time period displaying region 22 are disposed in the same manner as those in the normal operation state of FIG. 2. However, for the pulsed operation, the controlling portion 12 automatically changes the preset rotation number (first rotation number) which is used as the maximum rotation number to a smaller value. In the embodiment, the maximum rotation number is set to 15,000 rpm. And, in the pulsed operation, the rotor is not accelerated beyond the maximum rotation number. Although the automatically-set maximum rotation number may be arbitrarily determined, it may be selected within a range where the rotor 2 can be stably rotated under atmospheric pressure.

The vacuum degree displaying region 23 is further disposed in the display screen 30. The region may be displayed to be a gray or in a lower density as compared with that in FIG. 2, and an inhibition mark 27 is superimposedly disposed on the region. Since the display manner is changed in this way, the user can easily know that the vacuum pumps stop, during the pulsed operation. In the embodiment, exemplarily, the vacuum degree displaying region 23 is displayed in a lower density. However, the display manner is not restricted thereto. As long as the vacuum degree displaying region 23 is displayed in a manner different from that of the normal centrifuge mode (the state of FIG. 2), any display manner can be adapted. For example, the region may be displayed in a different color, or in a different shape, or the region may not be displayed.

On the display screen 30, a PULSE button 26 is displayed as a dedicated button for starting and stopping the pulsed operation. In the pulsed operation, only during a period when the user presses (touches) the PULSE button 26, the rotor 2 is accelerated. And, when the user releases the PULSE button 26, the rotor 2 is decelerated to stop. The operating manner will be described with reference to FIG. 4.

Figure 4:
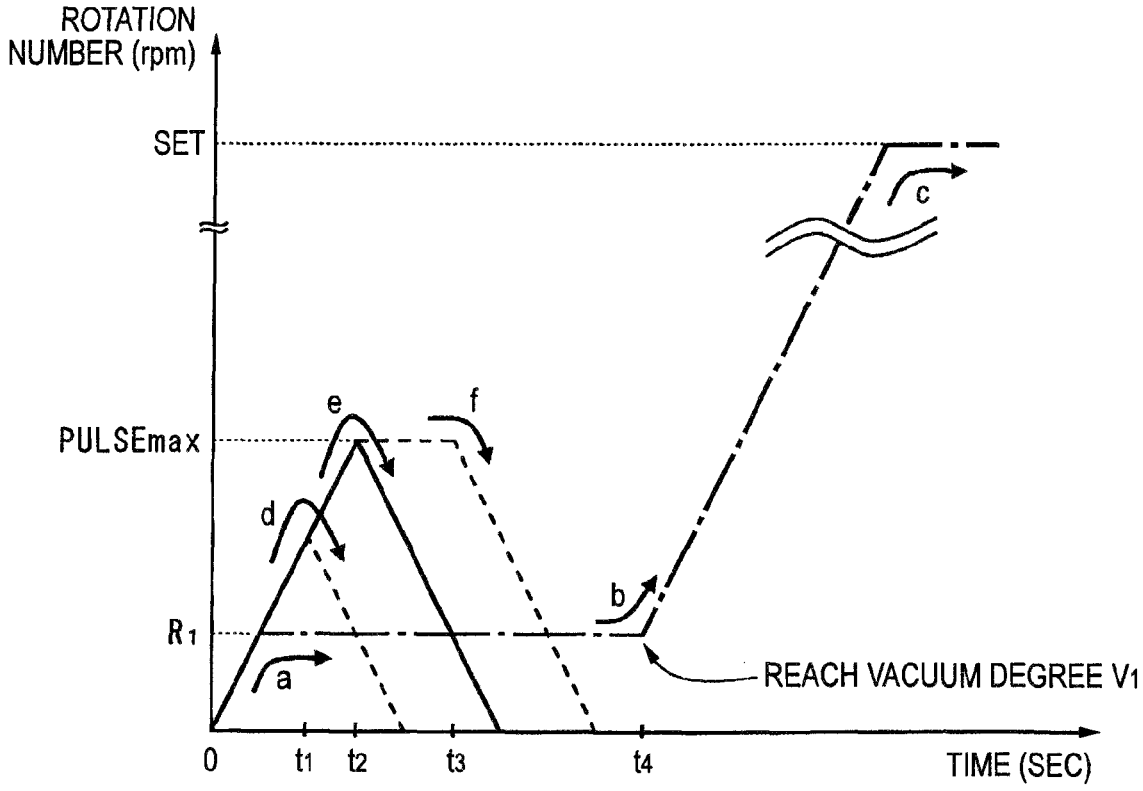
FIG. 4 illustrates the rotation states of a rotor 2 in the normal operation and pulsed operation of the centrifuge 1.

FIG. 4 illustrates the rotation states of the rotor 2 in the normal operation and pulsed operation of the centrifuge 1. In the normal centrifuge operation, the rotor 2 is started to rotate at time 0, and accelerated until the rotation number reaches a lower predetermined rotation number R1. Then, as indicated by arrow a or by the dash-dot line, the rotor 2 maintains the rotation number at R1, until the vacuum degree in the rotor chamber 3 reaches a predetermined vacuum degree V1. For example, the rotation number R1 is 5,000 rpm. When the pressure reaches the vacuum degree V1, the rotation number of the rotor chamber 3 is increased as indicated by arrow b to be accelerated to a preset rotation number (Set). As indicated by arrow c, then, the centrifuge operation is performed for a preset time period at the preset rotation number (Set).

Next, an example of an operation pattern in the pulsed operation will be described. In the pulsed operation, the user presses the PULSE button 26 at time 0. Then, the rotor 2 is accelerated, and the rotation number is increased. When the PULSE button 26 is continued to be pressed and at time t2 released, the driving force of the motor 9 is lost at the timing, and hence the rotor 2 is decelerated, so that the rotation number is lowered as shown by the solid line indicated by arrow e and the rotor 2 stops around past time t3. The timing when the rotor 2 stops depends on a timing when the PULSE button 26 is released. For example, when the button is released at time t1, the rotation number of the rotor 2 is lowered as indicated by arrow d, and the rotation of the rotor 2 stops around between times t2 and t3 as shown by the broken line.

On the other hand, even when the PULSE button 26 is continued to be pressed after time t2, the rotation of the rotor 2 reached the maximum rotation number (PULSEmax, first rotation number) in the pulsed operation at time t2, and the rotation number is maintained after time t2 as shown by the broken line. When the user releases the PULSE button 26 at time t3, the rotor 2 is decelerated as shown by the broken line indicated by arrow f, and stops.

In the above-described centrifuge having a vacuum pump, the operation (pulsed operation) in which the rotor 2 is accelerated to a rotation number of about 15,000 rpm or less without operating the vacuum pump, and rapidly decelerated to stop without maintaining the rotation number for a long time period can be performed. Therefore, a centrifuge having a vacuum pump can be used for dropping liquid droplets adhering to the inner sidewall of the container.

Next, the control procedure of the pulsed operation in the centrifuge 1 of the embodiment will be described with reference to the flowchart of FIG. 5. For example, the control is realized as software by causing the microcomputer in the controlling portion 12 to execute programs.

Figure 5:
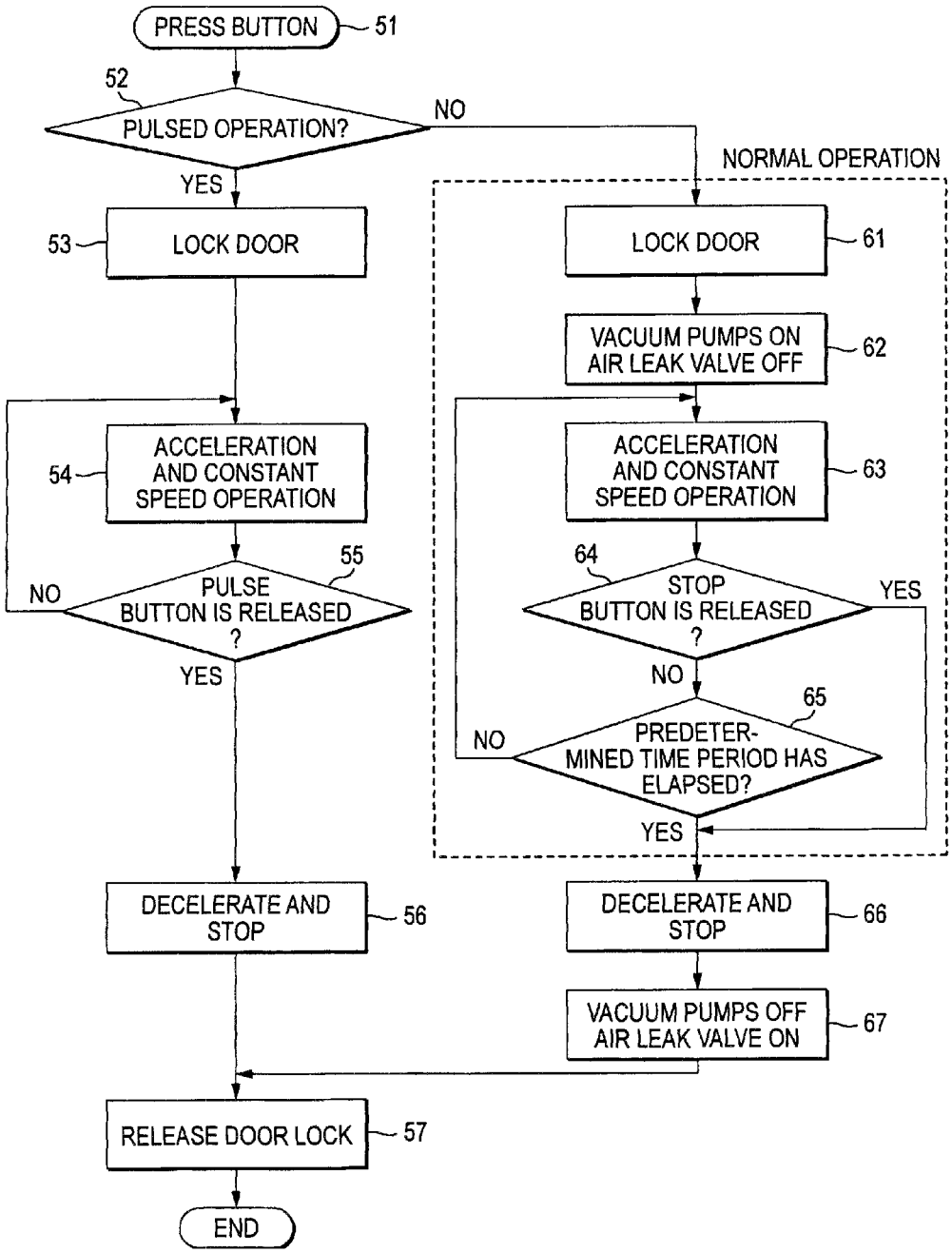
FIG. 5 illustrates an exemplary control procedure of the pulsed operation in the centrifuge 1 of Embodiment 1.

Referring to FIG. 5, when the user presses the START button or the PULSE button (Step 51), the controlling portion 12 detects the kinds of the displayed screen and the pressed button to determine whether the mode is the pulsed operation mode or the normal operation mode (Step 52). If the pulsed operation mode, the door is locked (Step 53), the acceleration and constant speed operation is performed, and it is monitored whether the PULSE button 26 is continued to be pressed or not (Steps 54, 55). When the user releases the PULSE button 26, the driving of the rotor 2 is stopped, and the rotor 2 is started to be decelerated to stop (Step 56). Then, the door lock is released, and the process is ended (Step 57).

If it is determined in Step 52 described above that the mode is not the pulsed operation mode, the control for the normal operation is performed. In the normal operation, the door is locked (Step 61), the two vacuum pumps (6, 7) are turned ON to operate, and the air leak valve 10 is turned OFF so that the valve is closed (Step 62). Thereafter, the rotor 2 is accelerated, and then performs a constant speed operation at the preset rotation number for the preset time period (Step 63). When, during the operation, the user presses the STOP button 25 (Step 64), or the preset time period elapses (Step 65), the process proceeds to Step 66, and the driving of the rotor 2 is stopped, and the rotor 2 is started to be decelerated to stop (Step 66). Thereafter, the two vacuum pumps (6, 7) are turned OFF to stop, and the air leak valve 10 is turned ON so that the valve is opened (Step 67). Then, the door lock is released, and the process is ended (Step 57).

In Embodiment 1, the centrifuge capable of performing the vacuum state centrifuge operation has the pulsed operation mode, and, in the pulsed operation mode, the vacuum pump is automatically stopped. Therefore, a high-speed centrifuge having a vacuum pump can be used in the pulsed operation mode, while, the vacuum pump is stopped in the pulsed operation mode. Therefore, the life period of the vacuum pump is prolonged, and operations of unnecessary devices can be stopped, thereby saving the poser.

Embodiment 2

Figure 6:
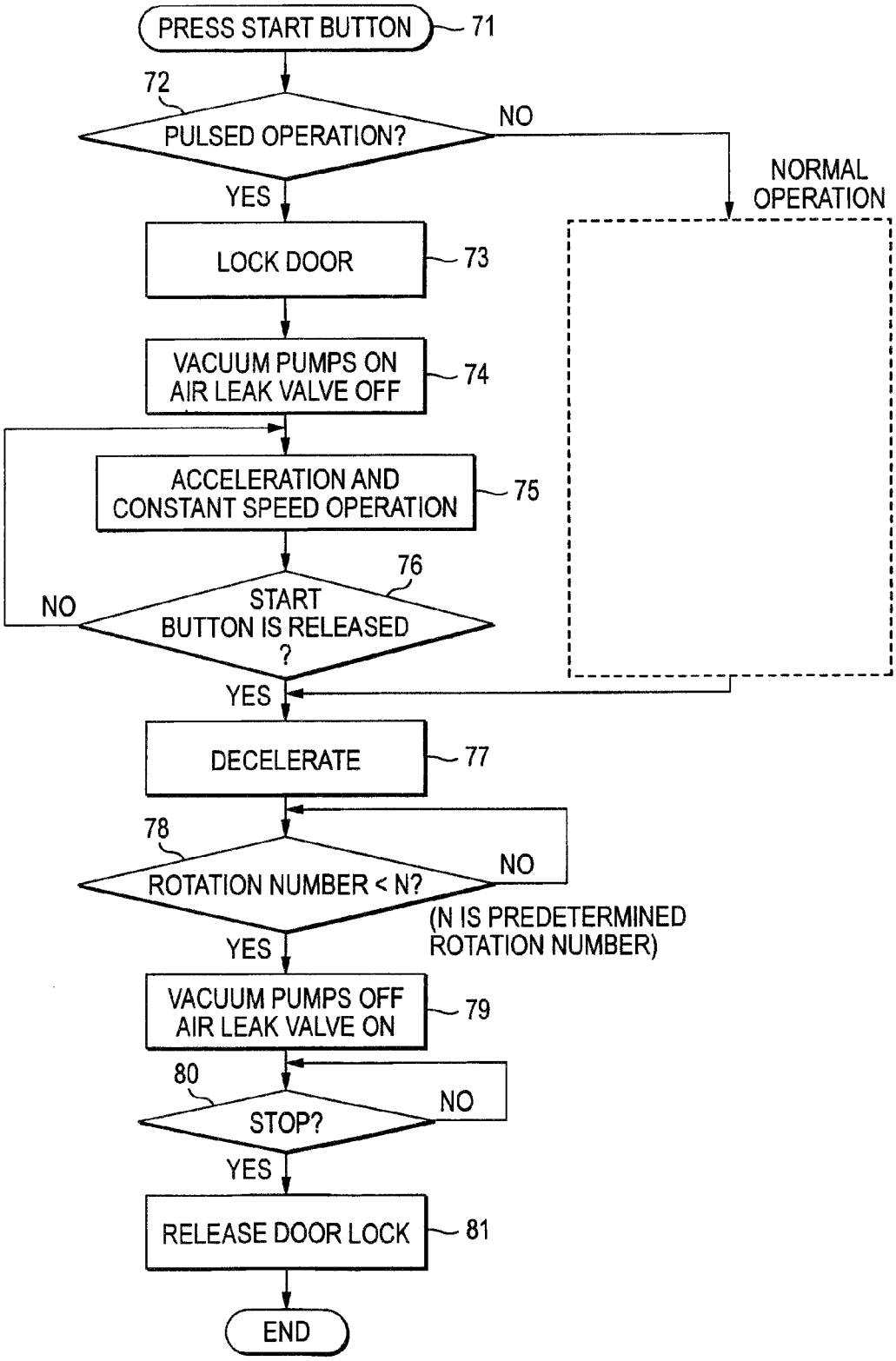
FIG. 6 illustrates an exemplary control procedure of the pulsed operation in the centrifuge 1 of Embodiment 2.

Next, the control procedure of the pulsed operation in the centrifuge 1 of Embodiment 2 will be described with reference to the flowchart of FIG. 6. Referring to FIG. 6, when the user presses the START button or the PULSE button (Step 71), the controlling portion 12 detects the kinds of the displayed screen and the pressed button to determine whether the mode is the pulsed operation mode or the normal operation mode (Step 72). In the pulsed operation mode, the door is locked (Step 73), the two vacuum pumps (6, 7) are turned ON, and the air leak valve is turned OFF so that the rotor chamber 3 is isolated from the atmosphere, and evacuation of the vacuum chamber 4 is started (Step 74). The evacuation is performed in the same manner as that in the normal operation, or alternatively performed so that the rotor 2 is accelerated even when the vacuum degree of the rotor chamber 3 does not reach a constant value. Next, the rotor 2 performs the acceleration and constant speed operation, and it is monitored whether the PULSE button 26 is continued to be pressed or not (Steps 75, 76).

When the user releases the PULSE button 26, the deceleration is started (Step 77). When the rotation number is reduced to be lower than a predetermined rotation number (second rotation number, for example, 1,000 rpm) (step 78), the two vacuum pumps (6, 7) are turned OFF, and the air leak valve 10 is turned ON so that ambient air is introduced into the vacuum chamber 4 (Step 79). When it is thereafter detected that the rotor 2 stops (Step 80), the door lock is released (Step 81), and the process is ended. If it is determined in Step 72 that the mode is not the pulsed operation mode but the normal operation, the process proceeds to the normal operation steps enclosed by the broken line. The steps are identical with Steps 61 to 65 enclosed by the broken line in FIG. 5, and therefore their description is omitted.

In Embodiment 2, also in the pulsed operation, the two vacuum pumps (6, 7) are turned ON as in the normal operation. However, the air leak valve 10 is opened before the rotor 2 stops, while it is usually opened after the rotor 2 completely stops. Therefore, the time period from the turn ON of the air leak valve 10 to the release of the door lock can be shortened. As a result, the time period for the pulsed operation while activating the vacuum pumps can be shortened.

While the embodiments have been described, the invention is not restricted thereto, and may be variously changed without departing the spirit thereof. In Embodiments 1 and 2, for example, the pulsed operation function is exemplified as being operated only when the PULSE button 26 is pressed. For example, a function may be realized so that, when the PULSE button 26 is once pressed, acceleration is performed until a predetermined rotation number (=a third rotation number which is equal to or smaller than PULSEmax) is attained, and, when the speed reaches the rotation number, or when a predetermined time period has elapsed after reaching, deceleration is automatically performed. In the case, preferably, a predetermined time period when the constant speed operation is maintained is a time period of one minute or shorter including zero second.

The display screen 30 for the pulsed operation shown in FIG. 3 may be variously changed. For example, the arrangement of the display screen 20 of FIG. 2 may be employed, and, when the START button 24 is pressed for a short time period, the normal operation mode may be set, and, when the START button 24 is kept pressed for a predetermined time period (for example, two seconds) or longer, the mode is automatically switched to the pulsed operation mode in place of the normal operation mode. In the pressure reduction in the pulsed operation, only the oil-sealed rotary vacuum pump 6 may be driven.

What is claimed is:

1. A centrifuge comprising:

a motor;

a rotor chamber accommodating a rotor that is rotated by the motor;

a vacuum pump that sucks air from the rotor chamber to reduce a pressure therein;

a controller that controls the centrifuge to operate selectively in one of a normal centrifuge operation mode and a pulsed operation mode in which the rotor is rotated for a short time at a speed equal to or lower than a predetermined set value; and an interface device connected to the controller to input information regarding the operation mode of the centrifuge, wherein the controller controls the vacuum pump to turn on when the centrifuge operation mode is selected by the interface device and to turn off when the pulsed operation mode is selected.

2. The centrifuge of claim 1, wherein, when the pulsed operation mode is selected, the controller controls the rotor speed at a value equal to or lower than a maximum rotation number of the centrifuge operation mode.

3. The centrifuge of claim 2, wherein the interface device includes a start button to start a rotation of the rotor.

4. The centrifuge of claim 3, wherein the controller is configured such that when the start button is pressed for a predetermined time period or longer, the controller controls the centrifuge to be switched to the pulsed operation mode so that the rotor is accelerated, and wherein, when the start button is released, the rotor is decelerated to stop.

5. The centrifuge of claim 3, wherein a dedicated button is provided as the start button in the interface portion, and wherein, when the dedicated button is pressed, the pulsed operation mode is performed.

6. The centrifuge of claim 5, wherein the controller is configured such that the controller controls the rotor to be accelerated when the dedicated button is pressed, and to decelerate to stop when the dedicated button is released.

7. The centrifuge of claim 5, wherein the controller is configured such that the controller controls the rotor to be accelerated when the dedicated button is pressed and to be decelerated to stop after a predetermined time period has been elapsed from the time when the dedicated button is pressed.

8. The centrifuge of claim 5, wherein the controller is configured such that the controller controls the rotor to be accelerated when the dedicated button is pressed and to be decelerated to stop after the rotor speed reaches the set value.

9. The centrifuge of claim 1, further including: a displaying portion that displays, in the pulsed operation mode, information thereon to indicate that the vacuum pump is stopped.

* * * * *